US006976673B2

(12) United States Patent
Madsen

(10) Patent No.: US 6,976,673 B2
(45) Date of Patent: Dec. 20, 2005

(54) SYSTEM AND METHOD FOR FLIPPING A MEDIA SHEET

(75) Inventor: Jeffrey C. Madsen, Eagle, ID (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 218 days.

(21) Appl. No.: 10/419,677

(22) Filed: Apr. 21, 2003

(65) Prior Publication Data

US 2004/0207147 A1 Oct. 21, 2004

(51) Int. Cl.[7] ..... B65H 29/00; B65H 39/10; B65H 29/66

(52) U.S. Cl. ..... 271/186

(58) Field of Search ..... 271/65, 291, 187, 271/184, 186; 399/364, 264

(56) References Cited

U.S. PATENT DOCUMENTS 4,307,800 A * 12/1981 Joa ..... 198/374
4,693,464 A * 9/1987 Honma ..... 271/265.02
4,715,594 A * 12/1987 Isobe et al. ..... 271/65
5,620,081 A * 4/1997 Kivits ..... 198/404
5,690,325 A * 11/1997 Morimoto ..... 271/65
5,732,623 A * 3/1998 Compera et al. ..... 101/232

FOREIGN PATENT DOCUMENTS

JP 2-215638 * 8/1990

* cited by examiner

*Primary Examiner*—Donald P. Walsh
*Assistant Examiner*—Kenneth W. Bower

(57) ABSTRACT

A system and method for flipping a media sheet. The novel system (10) includes a first mechanism (20) for inputting a media sheet (12) with a leading edge (22) and a trailing edge (24), a second mechanism (14) for receiving and holding the media sheet (12), a third mechanism (15) for translating the second mechanism (14) from an input position (16) to an output position (18), and a fourth mechanism (26) for outputting the media sheet (12) leading with the former trailing edge (24). In an illustrative embodiment, the second mechanism (14) includes a series of slots, each slot adapted to receive and hold a media sheet. One sheet can be input into a slot at the input position (16) while another sheet is output from a slot at the output position (18). Several slots (14) may be incorporated into the mechanism (10), such that slots index from the input position (16) to the output position (18) with one or more intermediate stops in between.

31 Claims, 5 Drawing Sheets

SYSTEM AND METHOD FOR FLIPPING A MEDIA SHEET

BACKGROUND OF THE INVENTION

1. Field of the Invention

The present invention relates to imaging systems. More specifically, the present invention relates to duplex printing.

2. Description of the Related Art

Image forming devices, such as printers and copiers, typically apply ink or toner to a media sheet—for example, a pre-cut sheet of paper—to form an image. Such devices may be adapted to form images on both of the opposing sides of the media sheet. This process is commonly referred to as duplex printing. The advantages of duplex printing include reducing the quantity of paper required for a print set as compared to one-sided (simplex) printing, and generating print sets with layouts resembling that of professionally printed books.

Conventional duplex printers require a mechanism—sometimes referred to as a duplexer—which can physically turn the media sheet over. After the sheet is printed on one side by a printing device, the duplexer flips the sheet over and then passes the sheet to either a second printing device or back to the same printing device that was used to print the first side of the sheet for second side printing.

A common method for flipping the media sheet involves diverting the sheet down a dead-end duplexing path, and then reversing the direction of motion of the sheet out of the duplexing path such that the former trailing edge of the sheet becomes the leading edge. Typically, the next sheet must wait until its predecessor has completely exited the duplexer before entering. This requires the gap between pages to be larger than the length of the sheet (assuming common speeds throughout the system). This excessive sized gap decreases sheet throughput and cuts the performance limits of the system in half.

Additionally, most printing technologies require a minimum amount of time to transpire before the image-side of the media can be universally handled, i.e. for second side printing. This can also limit system performance.

Hence, a need exists in the art for an improved system or method for duplex printing which offers greater sheet throughput than prior art methods.

SUMMARY OF THE INVENTION

The need in the art is addressed by the system and method for flipping a media sheet of the present invention. The novel system includes a first mechanism for inputting a media sheet with a leading edge and a trailing edge, a second mechanism for receiving and holding the media sheet, a third mechanism for translating the second mechanism from an input position to an output position, and a fourth mechanism for outputting the media sheet leading with the former trailing edge. In an illustrative embodiment, the second mechanism includes a series of slots, each slot adapted to receive and hold a media sheet. One sheet can be input into a slot at the input position while another sheet is output from a slot at the output position. This allows greater sheet throughput for the system. Several slots may be incorporated into the mechanism, such that slots index from the input position to the output position with one or more intermediate stops in between. This allows drytime to be provided to the media sheets.

DESCRIPTION OF THE INVENTION

Illustrative embodiments and exemplary applications will now be described with reference to the accompanying drawings to disclose the advantageous teachings of the present invention.

While the present invention is described herein with reference to illustrative embodiments for particular applications, it should be understood that the invention is not limited thereto. Those having ordinary skill in the art and access to the teachings provided herein will recognize additional modifications, applications, and embodiments within the scope thereof and additional fields in which the present invention would be of significant utility.

Figure 1:
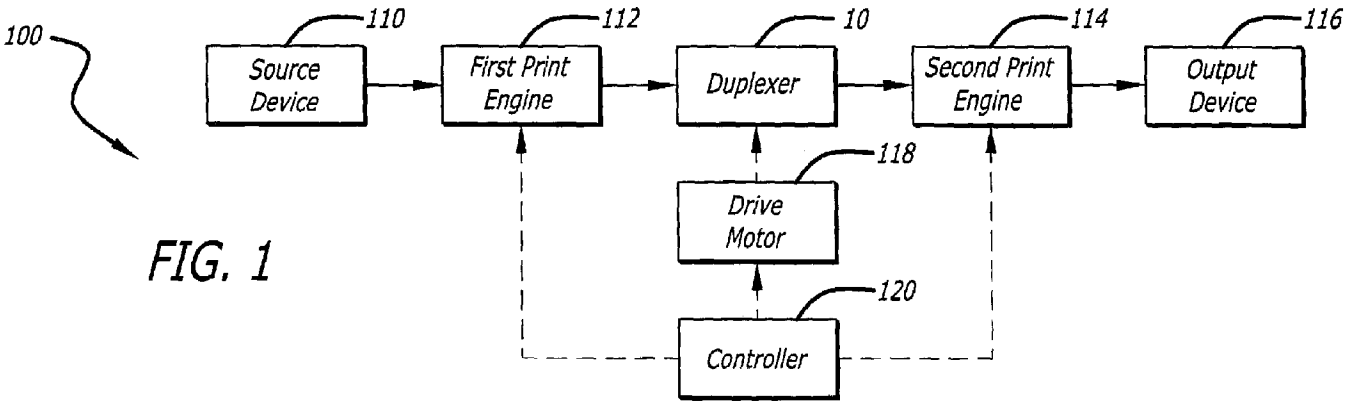
FIG. 1 is a simplified block diagram of a two-engine printing system designed in accordance with an illustrative embodiment of the present invention.

FIG. 1 is a simplified block diagram of a two-engine printing system 100 designed in accordance with an illustrative embodiment of the present invention. The printing system 100 includes a source device 110 which provides a plurality of media sheets that are to receive images thereon. The source device 110 directs a media sheet to a first print engine 112 configured to form an image on one side of the sheet. In the illustrative embodiment, after receiving an image on one side, the media sheet is flipped over by a duplexer 10 implemented in accordance with the teachings of the present invention. In the embodiment of FIG. 1, a second print engine 114 forms an image on the second side of the sheet. The sheet is then output to an output device 116. A motor 118 is provided to drive the duplexing device 10. A controller 120 controls the motor 118 and the print engines 112 and 114.

Figure 2:
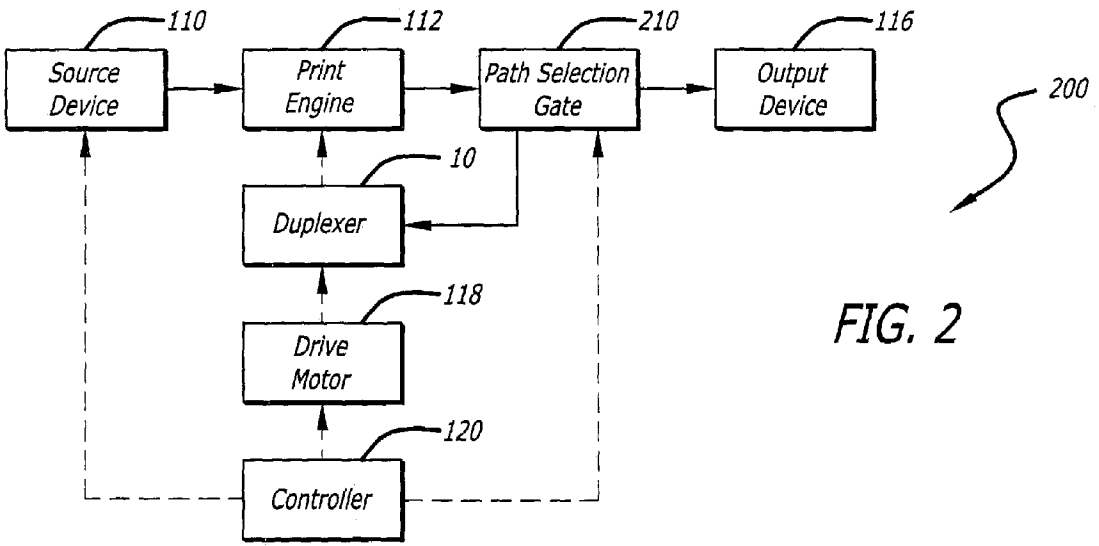
FIG. 2 is a simplified block diagram of a one-engine printing system designed in accordance with an illustrative embodiment of the present invention.

FIG. 2 is a simplified block diagram of a one-engine printing system 200 designed in accordance with an illustrative embodiment of the present invention. The printing system 200 includes a source device 110 which provides a plurality of media sheets that are to receive images thereon. The source device 110 directs a media sheet to a print engine 112 configured to form an image on one side of the sheet. After receiving an image on one side, a path selection gate 210 directs the media sheet to a duplexer 10 implemented in accordance with the teachings of the present invention. The media sheet is flipped over by the duplexer 10 and directed back to the print engine 112 for printing the second side of the sheet. The path selection gate 210 then outputs the sheet to an output device 116. A motor 118 is provided to drive the duplexing device 10. A controller 120 controls the motor 118, the print engine 112, and the path selection gate 210.

Figure 3A:
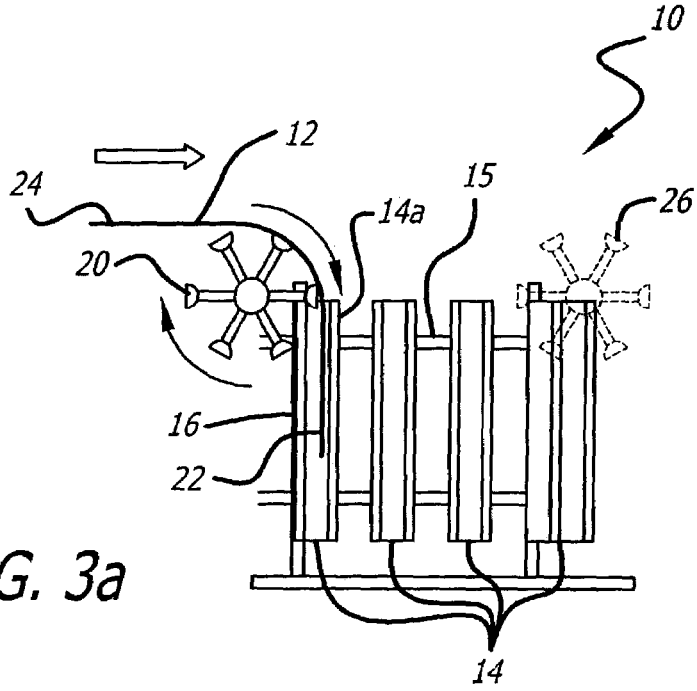
FIG. 3*a* is a cross-sectional view of a duplexing device designed in accordance with an illustrative embodiment of the present invention during an input operation.
Figure 3B:
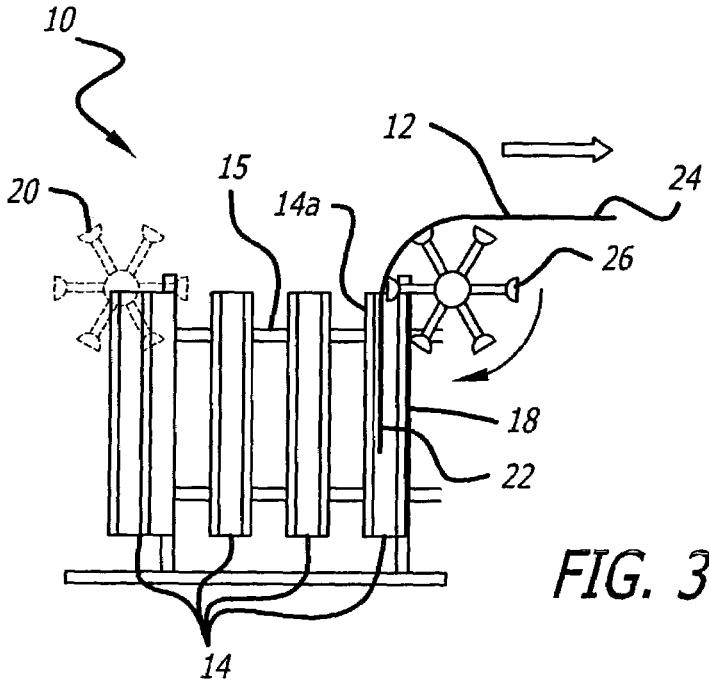
FIG. 3*b* is a cross-sectional view of a duplexing device designed in accordance with an illustrative embodiment of the present invention during an output operation.

FIGS. 3*a* and 3*b* are cross-sectional views of a duplexing device 10 designed in accordance with an illustrative embodiment of the present invention. FIG. 3*a* shows the duplexer 10 receiving a media sheet 12, while FIG. 3*b* shows the duplexer 10 outputting the sheet 12. The novel duplexer 10 includes a first mechanism 14 for receiving and holding the media sheet 12, and a second mechanism 15 which translates the first mechanism 14 from an input position 16 to an output position 18. In the illustrative embodiment, the mechanism 14 is a series of moving slots, each slot adapted to receive and hold a media sheet. The second mechanism 15 includes a conveyor to which the slots 14 are attached. As shown in FIG. 3*a*, an input mechanism 20, such as a vacuum rotor, inputs the media sheet 12 with a leading edge 22 and a trailing edge 24 into a slot 14*a* at the input position 16. The slot 14*a* translates to the output position 18, and, as shown in FIG. 3*b*, an output mechanism 26 outputs the media sheet 12 with its former trailing edge 24 now leading. After the sheet 12 has been ejected, the slot 14*a* follows a return path around the conveyor 15 from the output position 18 to the input position 16. In the illustrative embodiments, a controller 120 operates through a drive motor 118 (shown in FIGS. 1 and 2) to cause the conveyor 15 to be selectively rotated, translating the slots 14 from the input position 16 to the output position 18 and then returning the slots 14 back to the input position 16.

When the duplexer 10 has multiple slots 14, one media sheet can enter a slot at the input position 16, while another sheet simultaneously exits from a slot at the output position 18. If the duplexer 10 has more than two slots, a slot does not translate immediately from the input position 16 to the output position 18. It stops at one or more intermediate positions, allowing a pair of slots to receive a sheet and eject a sheet during each stop. Media sheets thus have time to dry while they are in the intermediate positions between the input and output positions.

Thus, the present invention allows simultaneous input and output of separate sheets by providing more than one space for sheets to reside in the duplex mechanism. Not only does this eliminate contact between sheets of media, it also creates an opportunity for increased drytime by buffering sheets in a compact fashion (face to face, instead of edge to edge). Drytime can be provided to whatever extent is desired (up to a certain limit) by increasing the number of intermediate stations which exist in the duplexer.

This method allows the gap between media sheets to be much smaller than the length of a sheet (as is required by prior art methods). The gap between sheets is determined by the time needed to translate from one position to the next.

Figure 4A:
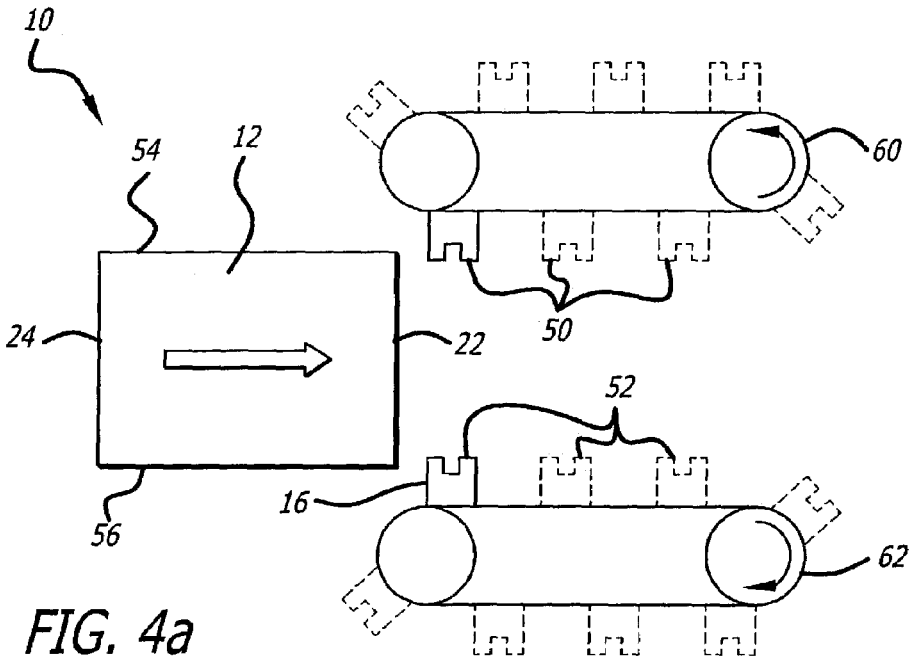
FIG. 4*a* is a top view of a duplexing device designed in accordance with an illustrative embodiment of the present invention during an input operation.
Figure 4B:
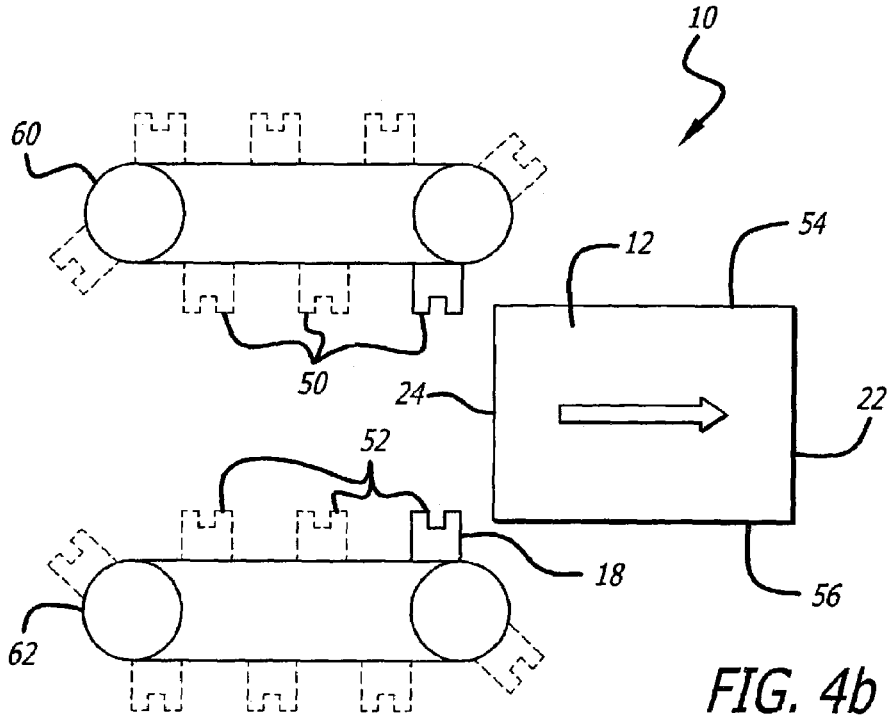
FIG. 4*b* is a top view of a duplexing device designed in accordance with an illustrative embodiment of the present invention during an output operation.

FIGS. 4*a*–4*d* show a duplexing device 10 designed in accordance with an illustrative embodiment of the present invention. FIG. 4*a* shows a top view of the duplexer 10 while receiving a media sheet 12, and FIG. 4*b* shows a top view of the duplexer 10 while outputting a media sheet 12. In this embodiment, each slot 14 (of FIGS. 3*a* and 3*b*) is formed by a pair of edge guides 50 and 52, each edge guide adapted to hold one edge of the media sheet 12. The edge guides 50 and 52 are facing each other and hold the media sheet 12 at opposite edges 54 and 56 of the sheet (the edges parallel to the direction of motion). A predetermined number of edge guides 50 are attached to a first conveyer 60, and the same number of edge guides 52 are attached to a second conveyer 62. Each edge guide 50 is paired with an edge guide 52 to form a slot 14 adapted to receive and hold a media sheet 12. The input device 20 (not shown) inputs the media sheet 12 into a slot formed by two edge guides 50 and 52 positioned at the input position 16. The conveyers 60 and 62 are synchronized to translate the edge guides 50 and 52, and the media sheet 12 held, to the output position 18, where the media sheet 12 is ejected. The edge guides 50 and 52 are indexed from the input position 16 to the output position 18, stopping at intermediate positions in between. After the sheet 12 has been output, each edge guide 50 and 52 follows a return path around the outside of its conveyor 60 and 62, respectively, back to the point where it can receive another sheet of media. In the illustrative embodiment, the first conveyor 60 is rotating counterclockwise, and the second conveyor 62 is rotating clockwise.

Figure 4C:
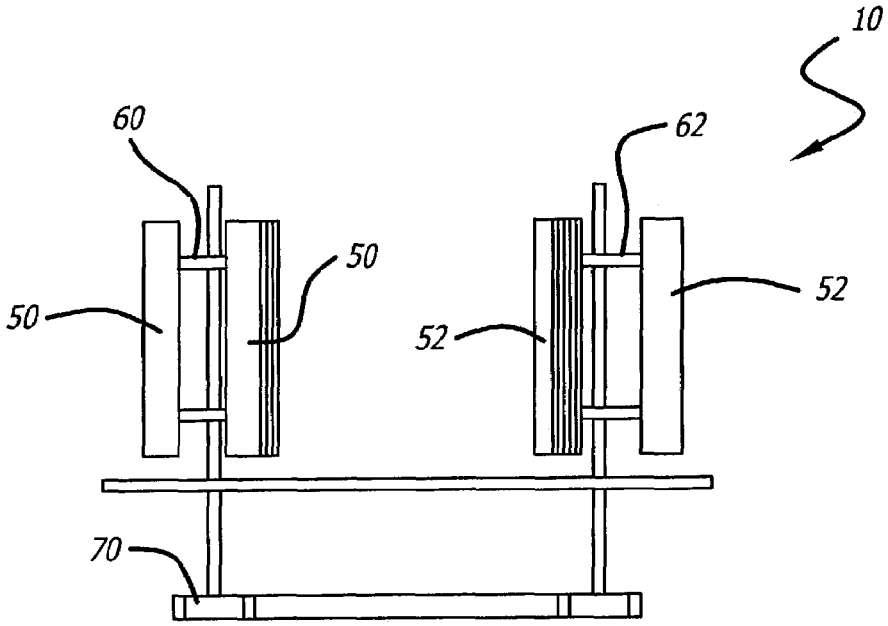
FIG. 4*c* is a side view of the illustrative embodiment of FIGS. 4*a* and 4*b*.
Figure 4D:
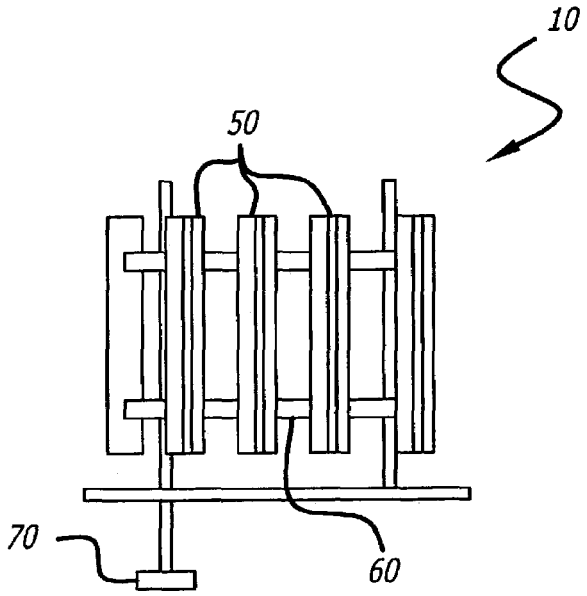
FIG. 4*d* is a front view of the illustrative embodiment of FIGS. 4*a* and 4*b*.

FIG. 4*c* shows a side view of the illustrative embodiment of FIGS. 4*a* and 4*b*, and FIG. 4*d* shows a front view (only one conveyer 60 is visible). As shown, the two conveyors 60 and 62 can be geared or belted to each other by a conveyor belt 70 for synchronization and to provide power. A controller 120 operates through a drive motor 118 (shown in FIGS. 1 and 2) coupled to the conveyer belt 70 to cause the conveyors 60 and 62 to be selectively rotated.

Figure 5:
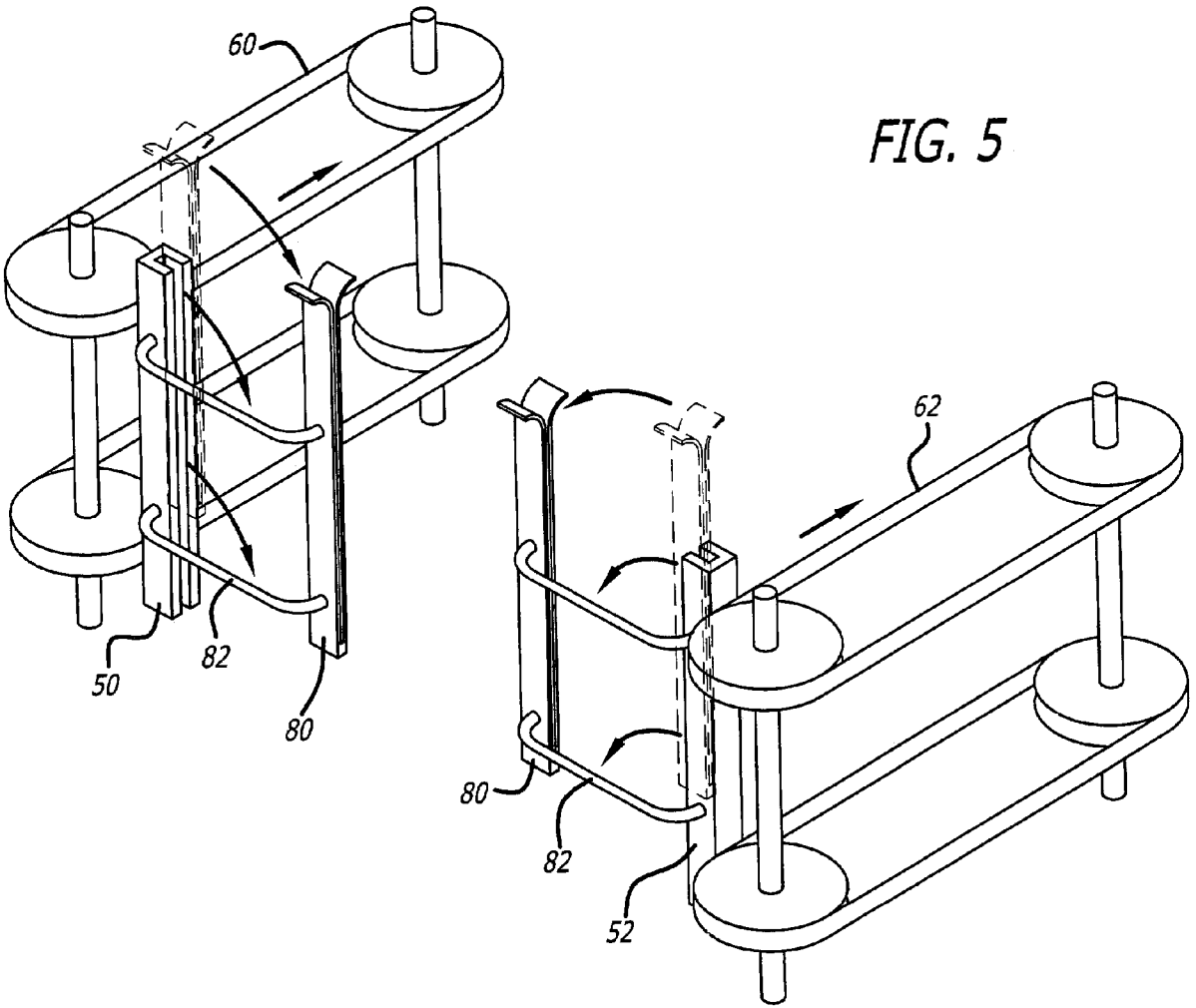
FIG. 5 shows an illustrative embodiment of the present invention including edge guides with center supports.

FIG. 5 shows an illustrative embodiment of the present invention including edge guides 50 and 52 with center supports 80 (only one pair of edge guides is shown for simplicity). Since the conveyors 60 and 62 support and transfer only two edges of each sheet, additional support may be needed closer to the center of the sheet, and on the bottom edge of the sheet. One way to accomplish this support without requiring the addition of significant product width is with center supports 80 which are attached to each edge guide 50 and 52. In the illustrative embodiment, the center supports 80 are U-shaped slots attached to the edge guides by bars 82. The center supports 80 reach out towards the center of the sheet to support the center as well as the bottom edge of the sheet. During the return path of the edge guides, these supports 80 can collapse into the edge guides to save space, then extend back out to receive the next sheet.

Thus, the present invention has been described herein with reference to a particular embodiment for a particular application. Those having ordinary skill in the art and access to the present teachings will recognize additional modifications, applications and embodiments within the scope thereof.

It is therefore intended by the appended claims to cover any and all such applications, modifications and embodiments within the scope of the present invention.

What is claimed is:

1. A system for flipping a media sheet comprising:

first means for inputting said media sheet with a leading edge a trailing edge and;

second means for receiving and holding said media sheet;

third means for linearly translating said second means from an input position to an output position; and fourth means for outputting said media sheet leading with said trailing edge.

2. The invention of claim 1 wherein said second means is adapted to hold a plurality of media sheets.

3. The invention of claim 2 wherein said second means is adapted to receive a first media sheet while a second sheet exits.

4. The invention of claim 2 wherein said second means includes a predetermined number of slots, each slot adapted to receive and hold a media sheet.

5. The invention of claim 4 wherein a first slot is located at the input position when a second slot is located at the output position.

6. The invention of claim 4 wherein each slot is formed by a pair of edge guides, each edge guide adapted to hold one edge of a media sheet and to face opposite and to face opposite lateral edges of the media sheet.

7. The invention of claim 2 wherein said second means includes a first conveyor with a predetermined number of edge guides attached thereto, and a second conveyor with a same number of edge guides attached thereto.

8. The invention of claim 7 wherein said first and second conveyors are arranged such that an edge guide from said first conveyor is paired with an edge guide from said second conveyor to form a slot adapted to receive and hold a media sheet.

9. The invention of claim 8 wherein each slot is indexed from the input position to the output position.

10. The invention of claim 9 wherein each edge guide follows a return path around its conveyor from the output position back to the input position.

11. The invention of claim 7 wherein said system further includes fifth means for synchronizing said first and second conveyors.

12. The invention of claim 11 wherein said fifth means is a conveyor belt coupled to said first and second conveyors.

13. The invention of claim 7 wherein said second means further includes sixth means for supporting a center of the media sheet.

14. The invention of claim 13 wherein said sixth means includes center supports attached to each edge guide.

15. The invention of claim 14 wherein said center supports collapse into the edge guides during the return path.

16. A duplexer comprising:

a first mechanism configured to input a media sheet with a leading edge and a trailing edge;

a second mechanism comprised of a plurality of slots, each slot adapted to receive and hold a media sheet;

a third mechanism configured to linearly translate said slots from an input position to an output position; and a fourth mechanism configured to output said media sheet leading with said trailing edge.

17. The invention of claim 16 wherein said second mechanism is adapted to receive a first media sheet while a second sheet exits.

18. The invention of claim 16 wherein a first slot is located at the input position when a second slot is located at the output position.

19. The invention of claim 16 wherein each slot is formed by a pair of edge guides, each edge guide adapted to hold one edge of a media sheet.

20. The duplexer of claim 16 wherein the media sheet extends along an axis from the leading edge to the trailing edge and wherein the third mechanism is configured to rotate the slots about at least one second axis substantially parallel to the first axis.

21. A duplexer for duplexing a media sheet with a leading edge, a trailing edge and two lateral edges comprising:

a first conveyor with a predetermined number of edge guides attached thereto;

a second conveyor with a predetermined number of edge guides attached thereto, wherein the edge guides are configured to face opposite lateral edges of the media sheet and wherein said first and second conveyors are arranged such that an edge guide from said first conveyor is paired with an edge guide from said second conveyor to form a slot adapted to receive and hold a media sheet;

an input mechanism for inputting the media into a slot at an input position;

a mechanism for rotating said first and second conveyors such that said slots index from said input position to an output position; and an output mechanism for outputting said media sheet at said output position leading with said trailing edge.

22. The invention of claim 21 wherein said mechanism for rotating includes a conveyor belt coupled to said first and second conveyors.

23. The invention of claim 21 wherein a center support is attached to each edge guide to support a center of said media sheet.

24. The duplexer of claim 21 wherein the media sheet extends along a first axis from the leading edge to the trailing edge and wherein the second conveyor rotates about at least one second axis substantially parallel to the first axis.

25. A duplex printer comprising:

a first print engine for forming an image on a first side of a media sheet;

a duplexer for flipping said media sheet comprising:

a first mechanism for inputting said media sheet with a leading edge and a trailing edge;

a second mechanism comprised of a plurality of slots, each slot adapted to receive and hold a media sheet;

a third mechanism for linearly translating said slots from an input position to an output position; and a fourth mechanism for outputting said media sheet leading with said trailing edge; and a second print engine for forming an image on a second side of a media sheet.

26. A duplex printer comprising:

a print engine for forming an image on a side of a media sheet;

a duplexer for flipping said media sheet comprising:

a first mechanism for inputting said media sheet with a leading edge and a trailing edge;

a second mechanism comprised of a plurality of slots, each slot adapted to receive and hold a media sheet;

a third mechanism for linearly translating said slots from an input position to an output position; and a fourth mechanism for outputting said media sheet leading with said trailing edge;

a path for returning said media sheet to said print engine for second side printing; and a path selection gate for directing a media sheet from said print engine to said duplexer when second side printing is required and to an output otherwise.

27. A method for flipping a media sheet including the steps of:

inputting said media sheet with a leading edge and a trailing edge into a mechanism adapted to receive and hold said sheet;

linearly translating said mechanism from an input position to an output position; and outputting said media sheet at said output position leading with said trailing edge.

28. The method of claim 27 further comprising:

printing a wet printing material upon a face of the sheet prior to inputting the sheet into the mechanism; and drying the wet printing material upon the face of the sheet during translating of the mechanism from the input position to the output position such that the wet printing material is substantially dry upon being outputted at the output position.

29. The method of claim 28 further comprising supporting the sheet in an unfolded state as the sheet is moved from the input position to the output position.

30. A method for flipping a media sheet having a leading edge, a trailing edge and two lateral edges the method including the steps of:

aligning a series of slots, each slot including a first edge guide adapted to face one of the lateral edges of the media sheet and a second edge guide adapted to face the other opposite lateral edge of the media sheet to hold the media sheet, such that a first slot is at an input position and a second slot is at an output position;

inputting said media sheet with a leading edge and a trailing edge into said first slot;

translating said series of slots to align subsequent pairs of slots with said input and output positions; and outputting said media sheet leading by said trailing edge when said first slot is aligned with said output position.

31. A duplexer comprising:

a first mechanism configured to input a media sheet extending along a first axis from a leading edge to a trailing edge;

a second mechanism including a plurality of slots, each slot adapted to receive and hold a media sheet;

a third mechanism configured to linearly translate the slots between an input position and an output position and to rotate the slots about at least one second axis substantially parallel to the first axis; and a fourth mechanism configured to output the media sheet leading with the trailing edge.

* * * * *

UNITED STATES PATENT AND TRADEMARK OFFICE

CERTIFICATE OF CORRECTION

PATENT NO. : 6,976,673 B2
APPLICATION NO. : 10/419677
DATED : December 20, 2005
INVENTOR(S) : Jeffrey C. Madsen It is certified that error appears in the above-identified patent and that said Letters Patent is hereby corrected as shown below:

In column 4, line 51, in Claim 1, delete "and" and insert -- and two lateral edges --, therefor.

In column 5, line 66, in Claim 21, after "media" insert -- sheet --.

In column 7, line 12, in Claim 30, after "slots" insert -- linearly --.

Signed and Sealed this

Tenth Day of November, 2009

David J. Kappos

David J. Kappos
*Director of the United States Patent and Trademark Office*